United States Patent [19]

Bray

[11] Patent Number: 5,001,837

[45] Date of Patent: Mar. 26, 1991

[54] ARCHERY BOW SIGHT ASSEMBLY

[75] Inventor: Raymond Bray, Walla Walla, Wash.

[73] Assignee: Martin Archery Inc., Walla Walla, Wash.

[21] Appl. No.: 567,315

[22] Filed: Aug. 14, 1990

[51] Int. Cl.[5] ..... F41G 1/00

[52] U.S. Cl. ..... 33/265

[58] Field of Search ..... 33/265; 124/87, 24 R

[56] References Cited

U.S. PATENT DOCUMENTS

| | | | |
|---|---|---|---|
| 3,013,336 | 12/1961 | Pennington | 33/265 |
| 3,487,548 | 1/1970 | Frydenlund | 33/265 |
| 4,541,179 | 9/1985 | Closson | 33/265 |
| 4,704,800 | 11/1987 | Stinson | 33/265 |
| 4,726,123 | 2/1988 | Keller | 33/265 |

OTHER PUBLICATIONS

Advertisement, "Sight Master", Published Prior to Jun. 1, 1989 (Including Photographs).

*Primary Examiner*—Harry N. Haroian

*Attorney, Agent, or Firm*—Wells, St. John & Roberts

[57] ABSTRACT

An archery bow sight assembly 10 is described for enabling an archer to more accurately aim the bow with respect to a target spaced from the archer. The assembly 10 has a mounting bracket 28 for mounting the assembly 10 to a mounting fixture 17. The assembly 10 projects forward of the bow handle section 13 with a sight unit 68 and a scale 62 and associated pointer 64 positioned forward of the handle section 13. The sight unit 68 and scale 62 are interconnected by a parallelogram subassembly 38 to move them in unison by a lever 86.

38 Claims, 5 Drawing Sheets

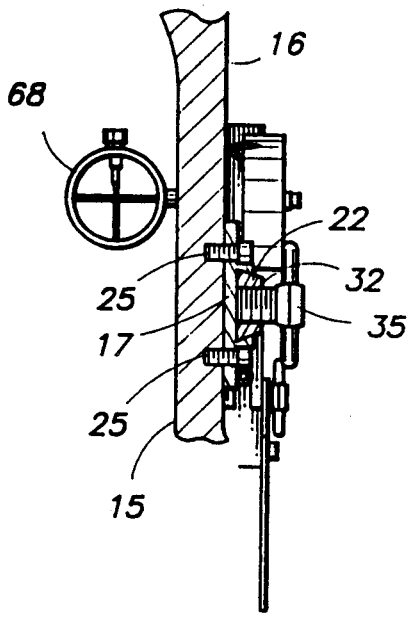
Fig 7
Fig 5
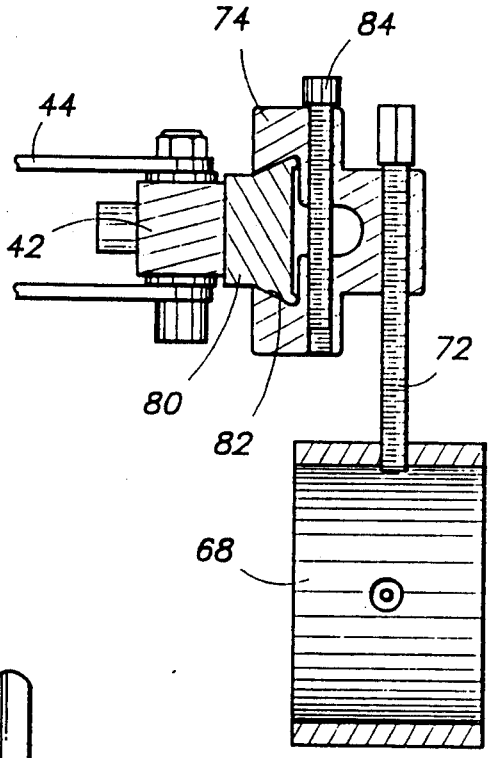
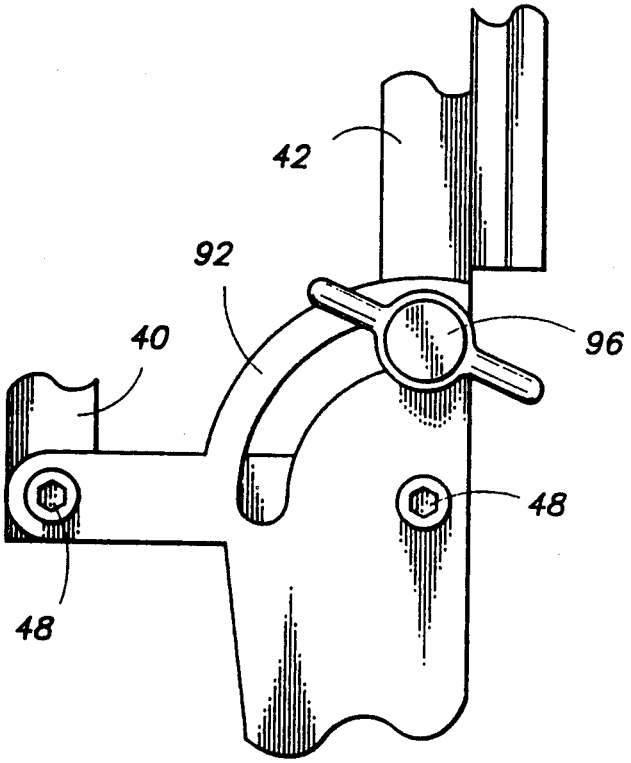
Fig 6

ARCHERY BOW SIGHT ASSEMBLY

TECHNICAL FIELD

This invention relates to archery bows and more particularly to sighting devices that are affixable to and carried by archery bows.

BACKGROUND OF THE INVENTION

Almost all serious archers use or have tried a sighting device on their bows all the way from very simple marking devices to rather complex movable devices. Invariably the sighting device is designed to assist the archer in adjusting the inclination of the archer bow in relation to the actual or perceived target distance between the archer and the target.

A number of the sighting devices are adjustable each having a sight unit that is vertically movable on the bow handle section and connected to a dial or scale pointer that is movable in unison with the movement of the sight unit to register the target distance corresponding to the position of the sight unit. For example, one such adjustable sighting device is marketed under the brand name "Sight Master" and is described in U.S. Pat. No. 4,541,179 granted to Robert A. Closson on Sept. 17, 1985. One of the disadvantages of such sighting device is it difficulty in easily and conveniently mounting to the archery bow and its tendency to tilt the bow laterally. Additionally such a sighting device requires the archer to refocus his/her eyes when viewing the sight unit and the scale pointer.

One of the major objectives of this invention is to overcome many of the disadvantages of the previous adjustable archery sighting devices. These and other objects and advantages of the present invention will become apparent upon reading the following detailed description of the preferred embodiment.

BRIEF DESCRIPTION OF THE DRAWINGS

The preferred embodiment of the invention is illustrated in the accompanying drawings, in which:

FIG. 5 is a horizontal cross sectional view taken along line 5—5 in FIG. 3 illustrating the adjustable mounting of the sighting unit;

FIG. 6 is an enlarged fragmentary side view of a locking device for locking the assembly in position once it has been adjusted; and FIG. 7 is a vertical cross sectional view taken along line 7—7 in FIG. 1 illustrating a mounting locking feature for adjustably securing the assembly to the archery handle section.

DETAILED DESCRIPTION OF THE PREFERRED EMBODIMENTS

The following disclosure of the invention is submitted in furtherance with the constitutional purpose of the Patent Laws "to promote the progress of science and useful arts" (Article 1, Section 8).

Figure 1:
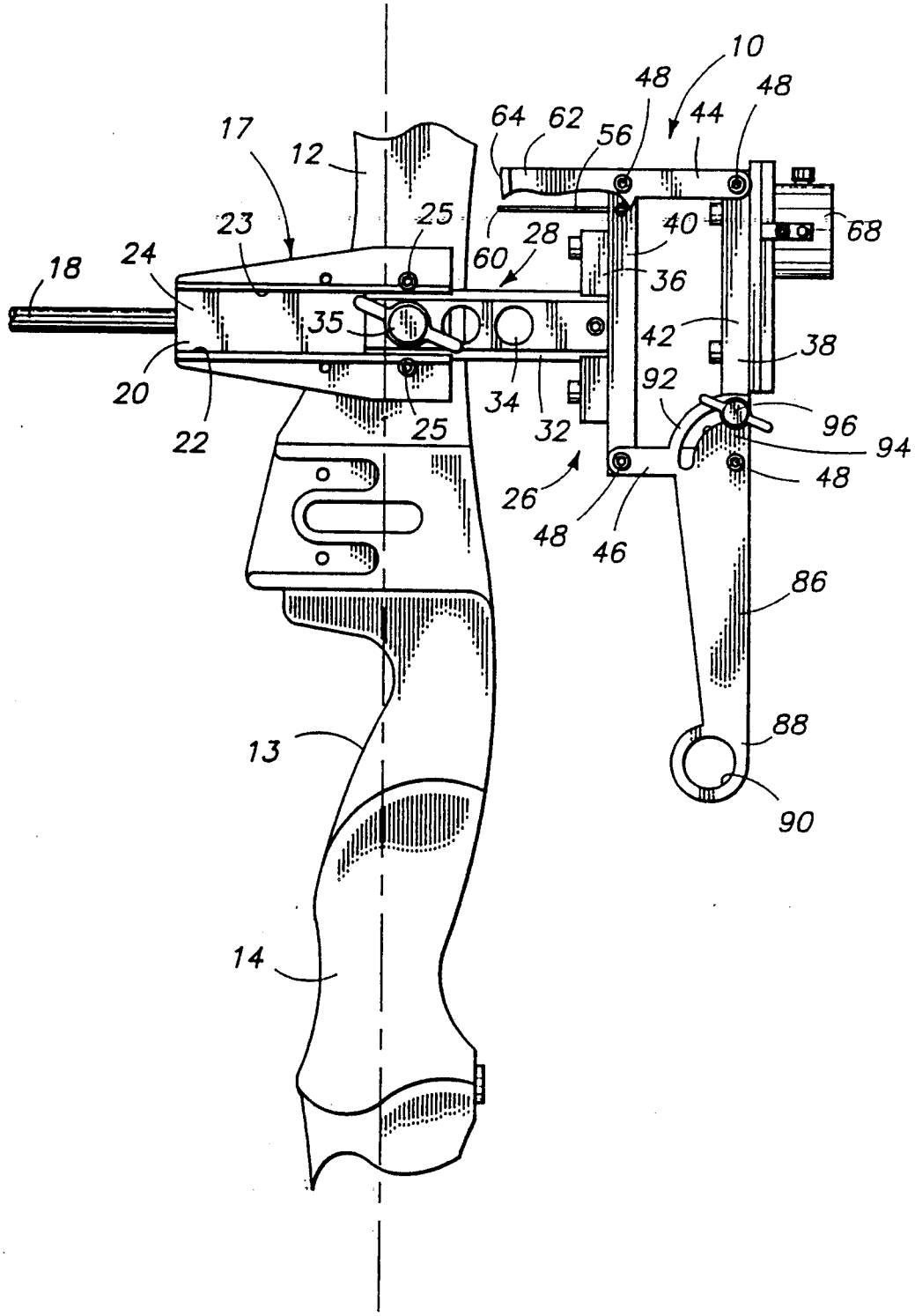
FIG. 1 is a fragmentary side view of an archery bow handle section showing an archery sighting assembly removable mounted thereto.
Figure 2:
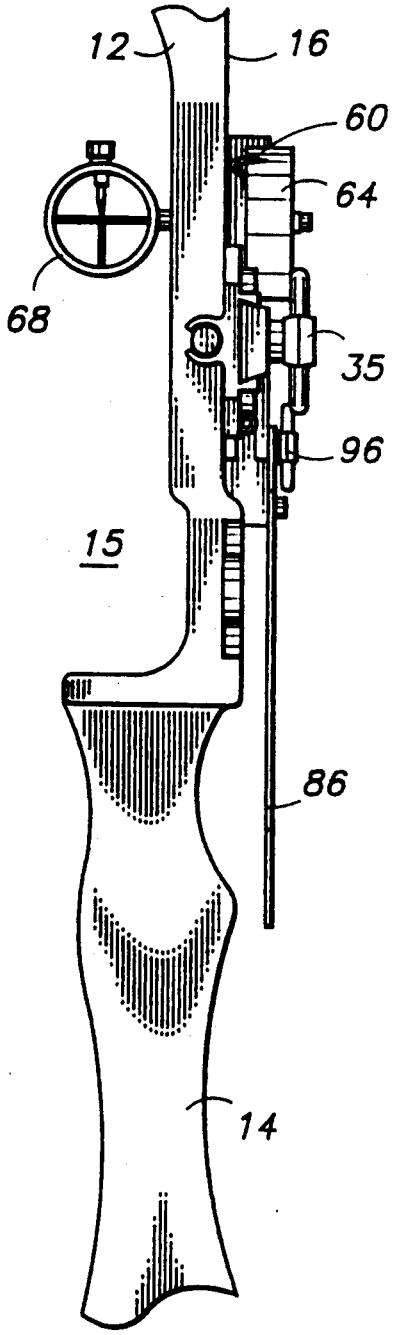
FIG. 2 is a fragmentary rear view of the archery bow handle section showing the archery sighting assembly mounted thereon particularly emphasizing the relationship of a sighting unit and a movable scale as viewed by the archer.
Figure 4:
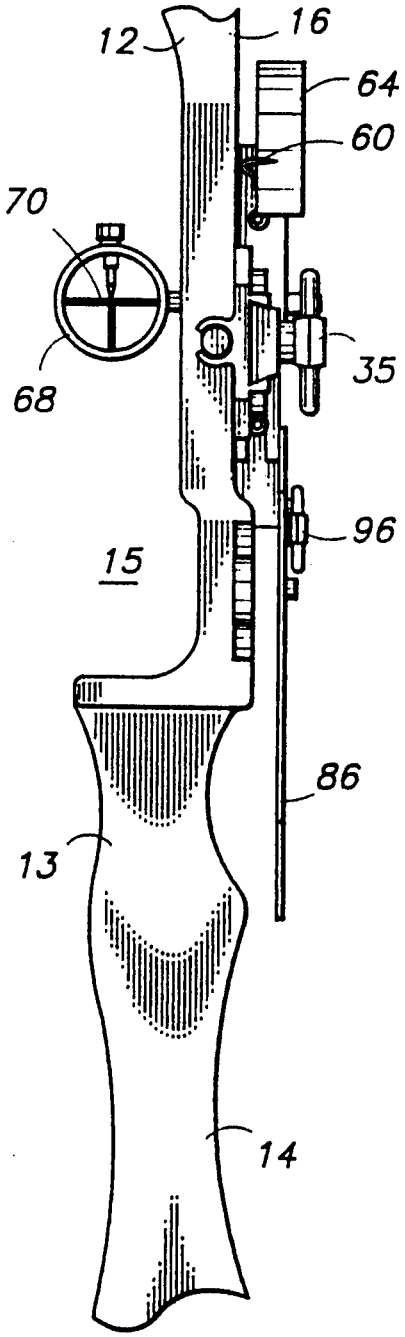
FIG. 4 is a fragmentary rear view similar to FIG. 2 except showing the elements in the second position illustrated in FIG. 3.
Figure 3:
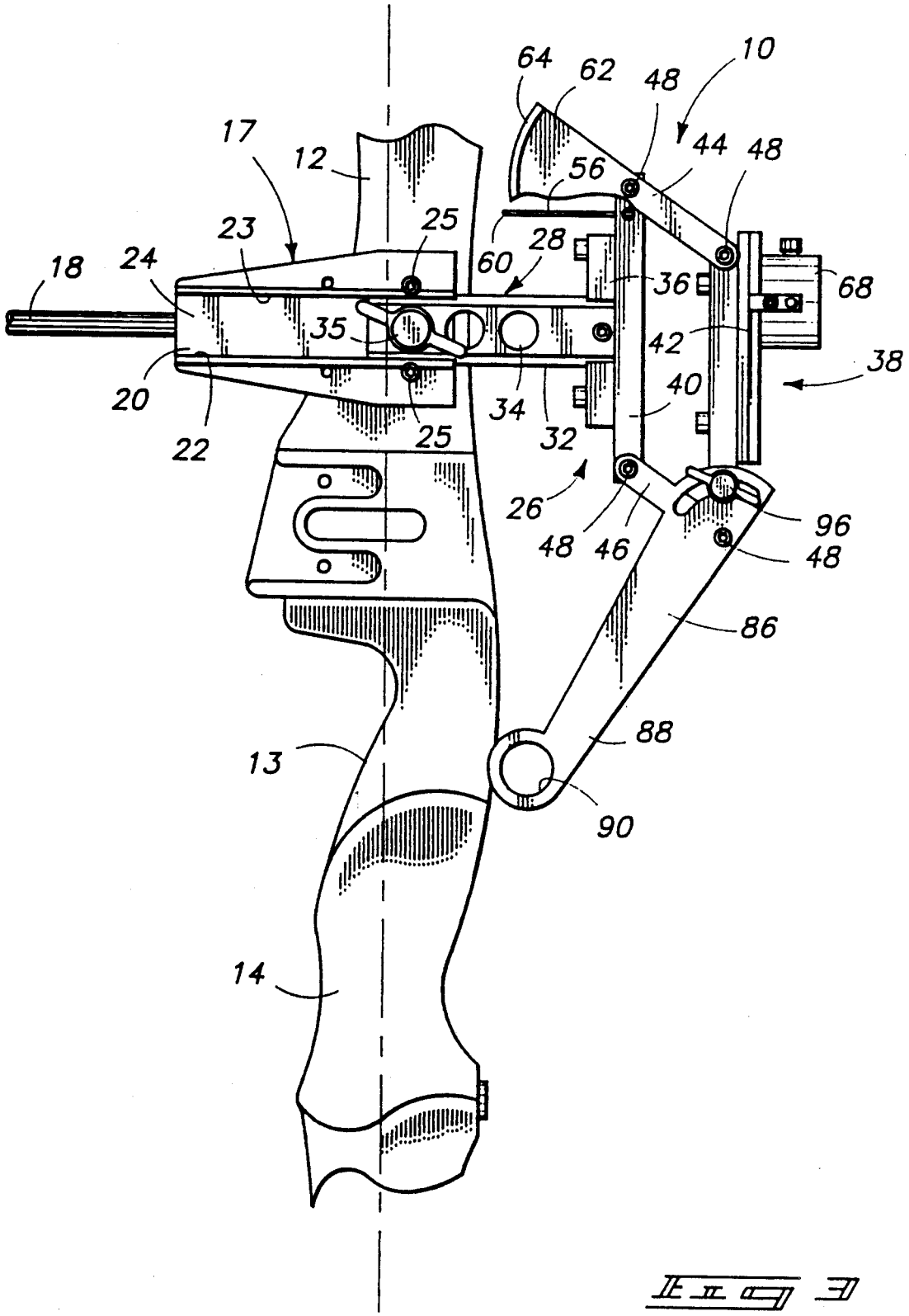
FIG. 3 is a fragmentary side view similar to FIG. 1 except showing the relative movement of the sighting unit and movable scale moved to a second position.

Referring now in detail to the drawings, particularly FIGS. 1 and 3, there is illustrated an archery bow sight assembly generally designated with the numeral 10 that is mountable to an archery bow 12. The archery bow 12 has an archery bow handle section 13 with a handle grip 14 for receiving the supporting hand of the archer. As shown in FIGS. 2 and 4, the archery bow handle section has an arrow window 15 formed thereon on side 15 which is opposite side 16. For a right handed archer, side 15 is generally considered to be the left side while side 16 is considered to be the right side.

Preferably the archery bow has a mounting fixture generally designated with the numeral 17 that is attached to side 16 for receiving the archery bow sight assembly 10. In the preferred embodiment, the mounting fixture 17 is in the form of a cable guard having a cable rod 18 that extends rearward for engaging the cables to maintain the cables spaced from a path of an arrow. The cable guard 17 includes a guideway element 20 formed therein. Preferably the guideway element 20 is in the form of a horizontal dovetail groove 22 having a front end opening 23 and a rear end opening 24. The cable guard 17 is secured to the side 16 of the archery bow handle section 14 by attaching bolts 25 illustrated in FIGS. 1 and 7.

Archery bow sight assembly 10 generally includes a frame designated with the numeral 26 that is mountable to the mounting fixture 17. Frame 26 includes a mounting bracket 28 that adjustably mounts to the mounting fixture 17. The mounting bracket has a guideway element in the form of a dovetail way 32 that is complementary to the dovetail groove 22 of the mounting fixture 17 so that the mounting bracket 28 may be slidably mounted in the dovetail groove 22 through the front opening 23 as illustrated in FIGS. 1 and 3. The mounting bracket 28 has mounting apertures 34 with a locking bolt 35 having a handle for securing the dovetail way 32 in the dovetail groove 22. Consequently, the archery bow sight assembly 10 may be adjustably mounted to the mounting fixture 17 for adjusting the position of the assembly 10 forward of the archery bow handle section 13.

The frame 26 further includes a sight and scale bracket 36 that is mounted to the forward end of the mounting bracket 28. The bracket 36 includes a parallelogram linkage subassembly 38. The parallelogram subassembly 38 includes two vertical oriented parallel elements 40, 42 and two parallel cross elements 44 and 46. Each of the parallel linkage elements 40, 42, 44 and 46 are interconnected by pivot bolts 48 about which the cross elements 44 and 46 pivot with respect to the vertical oriented element 40. The vertical oriented element 40 is held stationary with respect to the frame bracket 36. The sight and scale bracket 36 includes a stationary pointer 56 that extends rearward from the element 40 terminating in a pointer end 60. The bracket 36 includes movable scale 62 that moves in relationship to the pointer end 60. The scale 62 includes an arcuate face 64 that has an indicia surface formed thereon on which distance nomenclature may be presented as illustrated in FIGS. 2 and 4. The scale 62 is formed as an extension to the element 44 and pivots about one of the respective pivot bolt 48 to move the arcuate face 64 in an arcuate movement with respect to the stationary pointer end 60 for indicating the relative distance between the archer and the target as indicated by the indicia on the arcuate face 64.

The archery bow sight assembly 10 further includes a sight unit 68 that is adjustably mounted on the sight and scale bracket 36. The sight unit 68 preferably includes a sight hair 70 to permit the archer is position the inclination in the bow so that the sight hair, when viewed by the archer, is superimposed upon the target.

The sight unit 68 is mounted on a laterally adjustable screw shaft 72 that is shown more specifically in FIG. 5. The screw shaft 72 is mounted on a sight unit base 74 which includes a guideway element that is complementary to a corresponding guideway element on the linkage 42. Specifically, the guideway element on the base 74 includes a dovetail groove 82 formed therein that slidably receives a rail dovetail way 80. The sight unit 68 may be adjusted vertically with respect to the parallelogram element 42 by loosening the locking bolt 84. Once the sight has been adjusted to the bow, vertically and laterally, the locking element 84 is tightened to secure the sight unit 68 at a specific elevational position along the parallelogram element 42.

The sight and scale bracket 38 is adjustably mounted for movement by a lever 86 that extends downward to a lower end 88 that has a finger grip aperture 90 formed therein. When the archer is supporting the bow by gripping the handle grip 17, the archer is able to extend his/her index finger outward into the aperture 90 to be able to move the parallelogram subassembly 38. Specifically, movement of the lever 86 causes the vertically oriented parallelogram 42 to move upwardly or downwardly to vertically adjust the sight unit 68 with respect to the bow.

The lever 86 includes a locking means 92 that includes an arcuate groove 94 formed in the lever element. A locking bolt with a handle 96 is utilized to lock the parallelogram subassembly 38 in a fixed orientation once the adjustment has been made.

Figure 8:
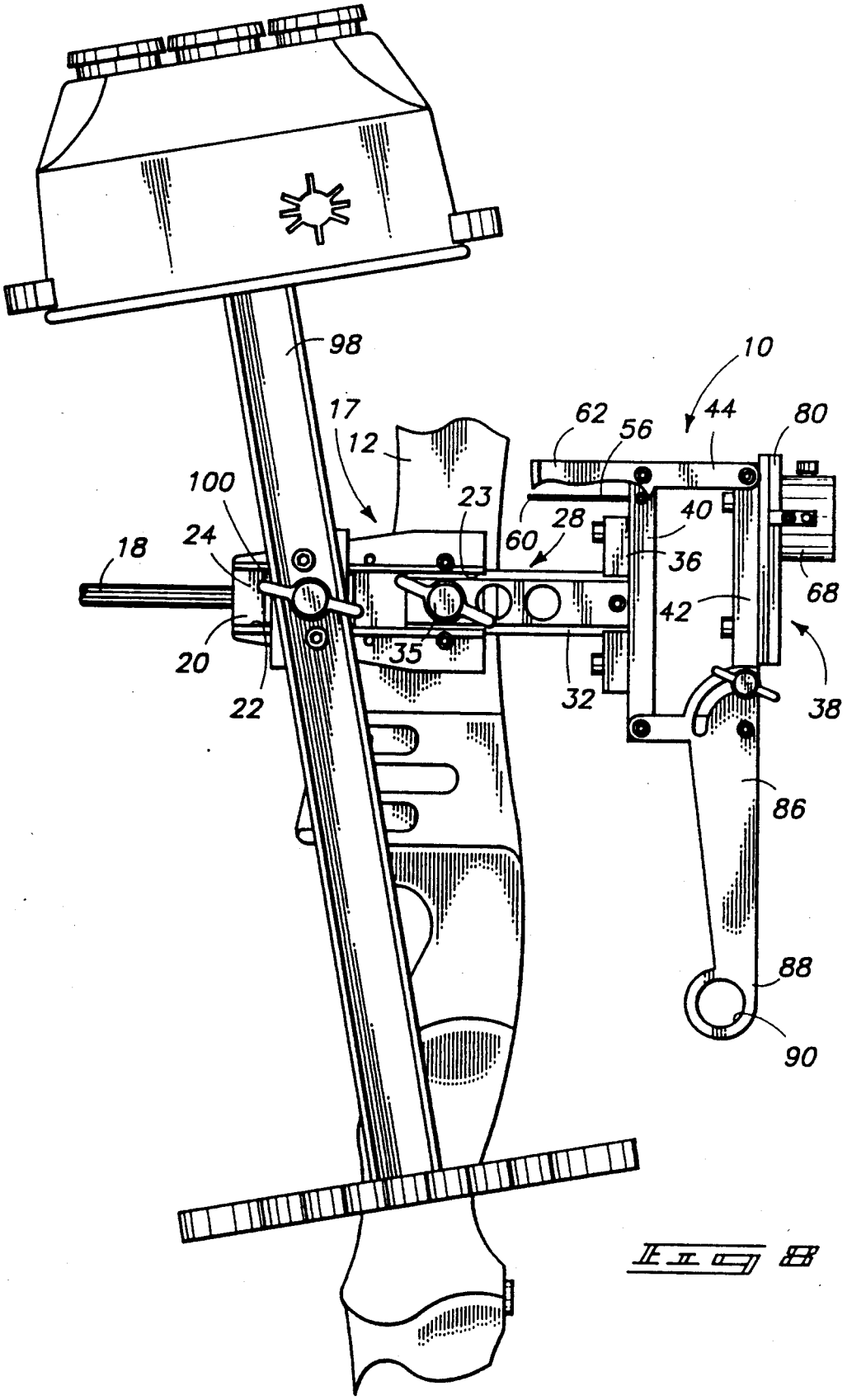

One of the advantages of this invention is the ability to be able to additionally mount other accessories to the mounting fixture 17 in addition to the archery bow sight assembly 10. For example, FIG. 8 illustrated the mounting of an arrow quiver 98 to the mounting fixture 17. Specifically, the arrow quiver 98 includes a dovetail way 100 that is positioned in the dovetail groove 22 through the rear end opening 24. Other types of accessories may be mounted in the dovetail groove 22 other than the arrow quiver 98.

It should be noted that both the sight unit 68 and the scale 62 and pointer ends 60 are all positioned forward of the archery bow handle section 13 with the sight unit 68 positioned on the left side or window side 15 of the bow while the scale 64 and pointer 60 are seen on the other side 16 of the bow as illustrated in FIGS. 2 and 4. It should be specifically noted that the pointer 60 is held stationary so that the archer when viewing the sight 68 and the scale 64 merely has to focus his/her eyes on the pointer without having to move the focus with a moveable pointer. Additionally, the pointer 60 and the sight 68 are forward of the bow and are generally in the same general focal plane so that the archer does not have to refocus his/her eyes in moving from the sight 68 to the scale 64 and back again.

Additionally it should be noted that the scale 62 and sight bracket 68, including the parallelogram linkage subassembly 38, are all positioned forward of the handle section so that it does not have a tendency to tilt the bow laterally. The weight of the archery bow sight assembly 10 is more evenly distributed with respect to the vertical axis of the bow to minimize the tendency of the bow to tilt to one side.

FIGS. 1 and 2 illustrate the archery bow sight assembly 10 in one extreme position with the sight unit 68 at an uppermost position while FIGS. 3 and 4 show the assembly in the opposite extreme position with the sight unit 68 at its lower position with respect to the scale 68. Again it should be noted that the pointer 60 is at a fixed position so that the archer does not have to follow a moving pointer to be able to read the indicated distance between the archer and the target.

These are just several of the advantages of the present invention.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims appropriately interpreted in accordance with the doctrine of equivalents.

I claim:

1. An archery bow sight assembly for assisting an archer in orienting the bow in relation to the distance between the archer and an archery target, comprising:

an archery sight;

a distance scale;

a sight frame having a mounting bracket for mounting the sight frame to a handle section of an archery bow in which the handle section has a sight window on one side thereof;

said sight frame having a sight and scale bracket projecting forward of the handle section for supporting both the sight and the scale forward of the handle section with the sight being positioned on the one side of the handle section and the scale on the other side of the handle section to enable the archer to view the sight through the sight window and to view the scale on the other side of the handle section directly opposite the sight window;

said sight and scale bracket operatively interconnecting the sight and scale to adjustably move the sight and scale in unison forward of and on opposite sides of the handle section.

2. The archery bow sight assembly as defined in claim 1 wherein the mounting bracket includes a bracket guideway element for slidably mounting to a corresponding guideway element formed on a mounting fixture on the opposite side of the handle section of the bow.

3. The archery bow sight assembly as defined in claim 2 wherein the mounting bracket includes locking means for securing the mounting way at one of multiple positions to position the sight and scale at various distances in front of the handle section of the bow.

4. The archery bow sight assembly as defined in claim 1 wherein the sight and scale bracket includes a parallelogram linkage operatively interconnecting the sight and scale in which the parallelogram linkage has two parallel linkage elements that are vertically oriented and interconnecting parallel cross elements that pivot in unison relative to the vertically oriented elements.

5. The archery bow sight assembly as defined in claim 4 wherein the sight is mounted to one of the vertically oriented linkage elements while the other vertically oriented linkage is held stationary.

6. The archery bow sight assembly as defined in claim 4 wherein the one vertically oriented linkage includes a first guideway element and wherein the sight has a corresponding second guideway element that is adjustably mounted on the first guideway element to enable the sight to be move vertically relative to the one vertically oriented linkage to initially adjust the vertical position of the sight relative to the bow handle.

7. The archery bow sight assembly as defined in claim 4 wherein the scale is mounted for pivotal movement in unison with pivotal movement of the cross elements relative to the vertical elements.

8. The archery bow sight assembly as defined in claim 1 wherein the sight and scale bracket includes a stationary pointer associated with the scale that remains in the same position independent of the position of the scale or sight.

9. The archery bow sight assembly as defined in claim 4 wherein the sight and scale bracket includes a lever operatively connected to the parallelogram linkage for moving the linkage in response to manual movement of the lever.

10. The archery bow sight assembly as defined in claim 9 wherein the lever includes a finger grip for enabling the archer to grip the lever with a finger to move the parallelogram manually while holding the bow at the handle section.

11. The archery bow sight assembly as defined in claim 4 wherein the sight and scale bracket has a locking means for locking the parallelogram linkage in a fixed position and prevent movement of the sight and scale.

12. The archery bow sight assembly as defined in claim 2 wherein mounting fixture is a cable guard having a substantially horizontal dovetail groove formed therein from a forward end opening to a rear end opening and wherein the mounting guideway of the mounting bracket is a dovetail way that is slidable into the dovetail groove through the forward end opening.

13. The archery bow sight assembly as defined in claim 12 wherein the mounting bracket includes locking means for securing the dovetail way in the dovetail groove spaced from the rear end opening to enable other archery accessories such as an arrow quiver to be mounted in the dovetail groove at the rear end opening.

14. An archery bow sight assembly for assisting an archer in orienting the bow in relation to the distance between the archer and an archery target, comprising:

a sight frame having a mounting bracket for mounting the sight frame to a handle section of an archery bow in which the handle section has a sight window on one side thereof;

an archery sight mounted on the sight frame for vertical movement with respect to the handle section;

a distance pointer stationarily mounted on the sight frame;

a distance scale associated with the distance pointer and mounted for movement in unison with movement of the archery sight;

said sight frame having a sight and scale bracket for supporting the sight forward of the handle section with the sight being positioned on the one side of the handle section and the scale on the other side of the handle section to enable the archer to view the sight through the sight window and to view the scale on the other side of the handle section directly opposite the sight window;

said sight and scale bracket operatively interconnecting the sight and scale to adjustably move the sight and scale in unison forward of and on opposite sides of the handle section.

15. The archery bow sight assembly as defined in claim 14 wherein the mounting bracket includes a bracket guideway element for slidably mounting to a corresponding guideway element formed on a mounting fixture on the opposite side of the handle section of the bow.

16. The archery bow sight assembly as defined in claim 15 wherein the mounting bracket includes locking means for securing the mounting way at one of multiple positions to position the sight and scale at various positions in relation to the handle section of the bow.

17. The archery bow sight assembly as defined in claim 14 wherein the sight and scale bracket includes a parallelogram linkage operatively interconnecting the sight and scale in which the parallelogram linkage has two parallel linkage elements that are vertically oriented and interconnecting parallel cross elements that pivot in unison relative to the vertically oriented elements.

18. The archery bow sight assembly as defined in claim 17 wherein the sight is mounted to one of the vertically oriented linkage elements while the other vertically oriented linkage is held stationary.

19. The archery bow sight assembly as defined in claim 17 wherein the one vertically oriented linkage includes a first guideway element and wherein the sight has a corresponding second guideway element that is adjustably mounted on the first guideway element to enable the sight to be move vertically relative to the one vertically oriented linkage to initially adjust the vertical position of the sight relative to the bow handle.

20. The archery bow sight assembly as defined in claim 17 wherein the scale is mounted for pivotal movement in unison with pivotal movement of the cross elements relative to the vertical elements.

21. The archery bow sight assembly as defined in claim 14 wherein the stationary pointer associated with the distance scale remains in the same position independent of the position of the scale or sight.

22. The archery bow sight assembly as defined in claim 17 wherein the sight and scale bracket includes a lever operatively connected to the parallelogram linkage for moving the linkage in response to manual movement of the lever.

23. The archery bow sight assembly as defined in claim 22 wherein the lever includes a finger grip for enabling the archer to grip the lever with a finger to move the parallelogram manually while holding the bow at the handle section.

24. The archery bow sight assembly as defined in claim 17 wherein the sight and scale bracket has a locking means for locking the parallelogram linkage in a fixed position and prevent movement of the sight and scale.

25. The archery bow sight assembly as defined in claim 15 wherein mounting fixture is a cable guard having a substantially horizontal dovetail groove formed therein from a forward end opening to a rear end opening and wherein the mounting guideway of the mounting bracket is a dovetail way that is slidable into the dovetail groove through the forward end opening.

26. The archery bow sight assembly as defined in claim 25 wherein the mounting bracket includes locking means for securing the dovetail way in the dovetail groove spaced from the rear end opening to enable other archery accessories such as an arrow quiver to be mounted in the dovetail groove at the rear end opening.

27. An archery bow sight assembly for assisting an archer in orienting the bow in relation to the distance between the archer and an archery target, comprising:

an archery sight;

a distance scale;

a sight frame having a mounting bracket for mounting the sight frame to a handle section of an archery bow in which the handle section has a sight window on one side thereof;

said sight frame having a sight and scale bracket projecting forward of the handle section for supporting the scale forward of the handle section with the sight being positioned on the one side of the handle section and the scale on the other side of the handle section to enable the archer to view the sight through the sight window and to view the scale on the other side of the handle section directly opposite the sight window;

said sight and scale bracket operatively interconnecting the sight and scale to adjustably move the sight and scale in unison forward of and on opposite sides of the handle section; and wherein the mounting bracket includes a bracket guideway element for slidably mounting to a corresponding guideway element formed on a mounting fixture on the opposite side of the handle section of the bow.

28. The archery bow sight assembly as defined in claim 27 wherein the mounting bracket includes locking means for securing the mounting way at one of multiple positions to position the sight and scale at various distances in front of the handle section of the bow.

29. The archery bow sight assembly as defined in claim 27 wherein the sight and scale bracket includes a parallelogram linkage operatively interconnecting the sight and scale in which the parallelogram linkage has two parallel linkage elements that are vertically oriented and interconnecting parallel cross elements that pivot in unison relative to the vertically oriented elements.

30. The archery bow sight assembly as defined in claim 29 wherein the sight is mounted to one of the vertically oriented linkage elements while the other vertically oriented linkage is held stationary.

31. The archery bow sight assembly as defined in claim 29 wherein the one vertically oriented linkage includes a first guideway element and wherein the sight has a corresponding second guideway element that is adjustably mounted on the first guideway element to enable the sight to be move vertically relative to the one vertically oriented linkage to initially adjust the vertical position of the sight relative to the bow handle.

32. The archery bow sight assembly as defined in claim 29 wherein the scale is mounted for pivotal movement in unison with pivotal movement of the cross elements relative to the vertical elements.

33. The archery bow sight assembly as defined in claim 27 wherein the sight and scale bracket includes a stationary pointer associated with the scale that remains in the same position independent of the position of the scale or sight.

34. The archery bow sight assembly as defined in claim 29 wherein the sight and scale bracket includes a lever operatively connected to the parallelogram linkage for moving the linkage in response to manual movement of the lever.

35. The archery bow sight assembly as defined in claim 34 wherein the lever includes a finger grip for enabling the archer to grip the lever with a finger to move the parallelogram manually while holding the bow at the handle section.

36. The archery bow sight assembly as defined in claim 29 wherein the sight and scale bracket has a locking means for locking the parallelogram linkage in a fixed position and prevent movement of the sight and scale.

37. The archery bow sight assembly as defined in claim 27 wherein mounting fixture is a cable guard having a substantially horizontal dovetail groove formed therein from a forward end opening to a rear end opening and wherein the mounting guideway of the mounting bracket is a dovetail way that is slidable into the dovetail groove through the forward end opening.

38. The archery bow sight assembly as defined in claim 37 wherein the mounting bracket includes locking means for securing the dovetail way in the dovetail groove spaced from the rear end opening to enable other archery accessories such as an arrow quiver to be mounted in the dovetail groove at the rear end opening.

* * * * *